US006884032B1

(12) United States Patent
Messih et al.

(10) Patent No.: US 6,884,032 B1
(45) Date of Patent: Apr. 26, 2005

(54) WATER PUMP AND METHOD OF CLOSURE

(75) Inventors: Nader A. Messih, Farmington Hills, MI (US); Ernest C. Ionescu, East Lansing, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/717,121

(22) Filed: Nov. 19, 2003

(51) Int. Cl.[7] ..... F04D 29/62

(52) U.S. Cl. ..... 415/201; 415/215.1; 156/92; 156/293; 29/458; 29/469.5; 29/525; 29/527.2; 29/888.021; 29/888.024; 29/DIG. 1

(58) Field of Search ..... 415/118, 201, 215.1; 156/92, 293; 29/458, 469.5, 525, 527.2, 888.02, 29/888.021, 888.024, DIG. 1

(56) References Cited

U.S. PATENT DOCUMENTS 2,364,168 A * 12/1944 Shallenberg ..... 415/201
2,521,638 A * 9/1950 Lamm ..... 415/201
4,750,457 A * 6/1988 Bonutti ..... 29/458

* cited by examiner

*Primary Examiner*—Christopher Verdier
(74) *Attorney, Agent, or Firm*—Karl F. Barr, Jr.

(57) ABSTRACT

A water pump having a housing with an opening defined by an axial inner retention surface and a radial outer surface. A plug formed of sheet metal includes a radial closure portion surrounded by a continuous axial flange adapted to be press fitted into the inner retention surface of the housing. Before assembly, an adhesive is applied to either the axial flange of the plug or the inner retention surface of the housing. The plug is then pressed into the housing so that the flange of the plug engages the inner retention surface of the housing. After the adhesive sets, a water tight seal is formed between the plug and the housing adequate to hold pressurized coolant within the housing of the water pump.

7 Claims, 2 Drawing Sheets

WATER PUMP AND METHOD OF CLOSURE

TECHNICAL FIELD

This invention relates to automotive engine water pumps and, more particularly, to methods of closing an impeller assembly opening.

BACKGROUND OF THE INVENTION

An automotive engine water pump is commonly provided with a housing having an assembly opening for inserting an impeller assembly into the housing. A cover is provided to close the opening and may be secured by screws and sealed by an o-ring seated in a groove of the housing or cover to prevent leakage of the engine coolant. Machining of the housing and/or cover and assembly of the cover, screws and o-ring to the housing adds complexity and cost to the pump.

A simplified automotive water pump assembly not requiring O-rings or machined grooves is desired to reduce assembly time, complexity, and costs.

SUMMARY OF THE INVENTION

The present invention provides a simplified water pump. The pump having a housing with an assembly opening for installation of an impeller assembly. The opening is defined by a continuous axial inner retention surface and a radial outer surface. The opening is closed by a plug formed of sheet metal having a generally radial closure portion surrounded by a continuous axial flange connecting with a radial lip.

After the impeller assembly is installed within the housing, an adhesive is applied to the axial flange of the plug or the inner retention surface of the housing. The plug is then pressed into the assembly opening. As the plug is pressed into the opening, the axial flange is pressed inward toward the axis of the plug to create a press fit that retains the plug in the housing. When the plug is fully pressed into the opening, the radial lip of the plug engages the radial outer sealing surface of the housing to provide a stop for the plug.

Once the plug and housing are assembled, the adhesive is allowed to set, creating a seal that prevents leakage of pressurized coolant and increases the retaining force of the plug closing the opening.

These and other features and advantages of the invention will be more fully understood from the following description of certain specific embodiments of the invention taken together with the accompanying drawings.

DESCRIPTION OF THE PREFERRED EMBODIMENT

Figure 1:
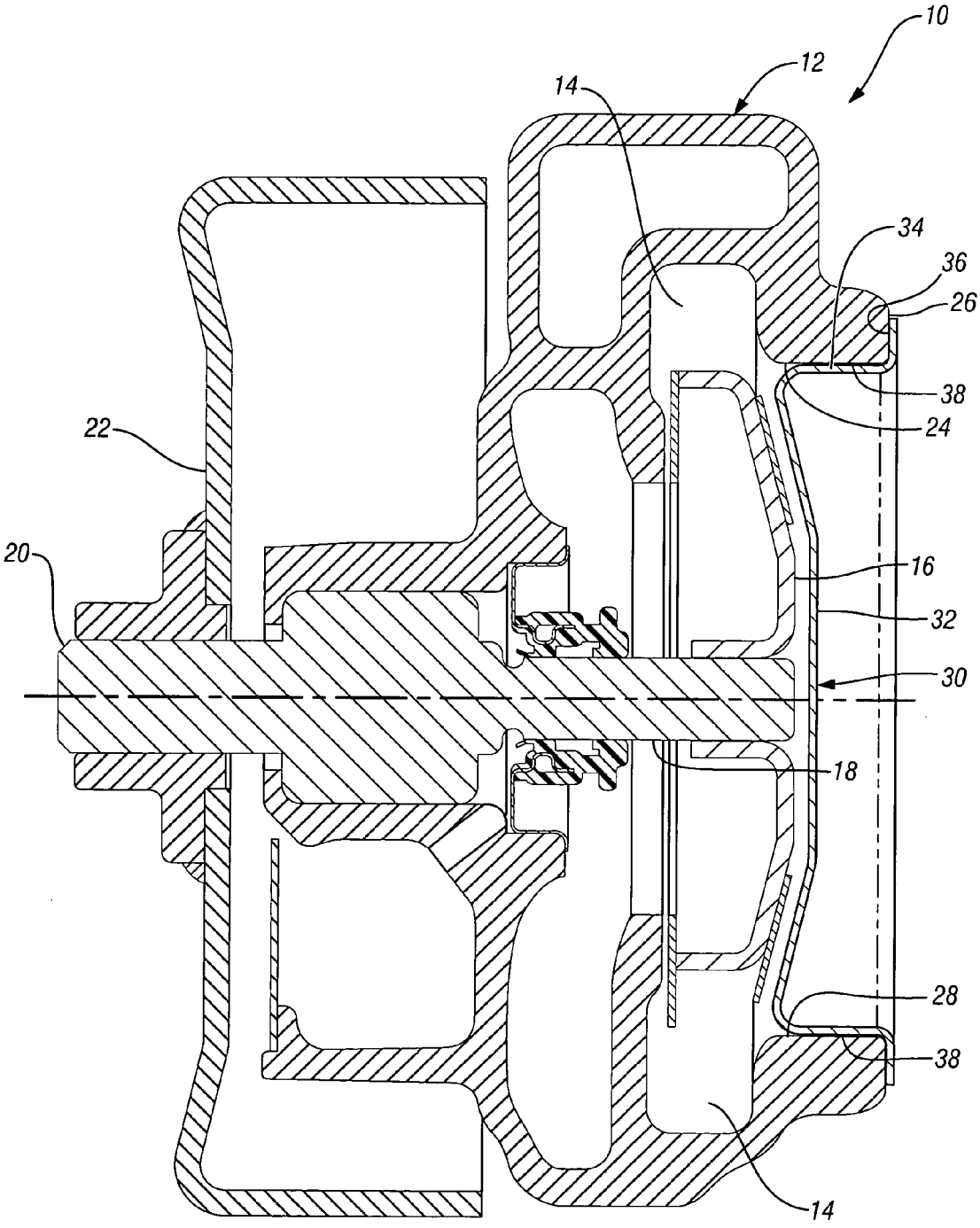
FIG. 1 is a cross-sectional view of an automotive water pump having an assembly opening closure according to the present invention.

Referring now to FIG. 1 of the drawings in detail, numeral 10 generally indicates a water pump for an automotive engine. The water pump has a housing 12 internally defining a flow chamber 14 containing a rotatable impeller 16. The impeller 16 is fixed on a drive shaft 18 forming an assembly rotatable in the housing 12. An exterior portion 20 of the drive shaft 18 mounts a pulley 22 adapted to be driven by an accessory drive belt for pumping pressurized coolant through an engine cooling system.

For assembly purposes the housing 12 has an impeller assembly opening 24 adjacent the impeller 16. The opening 24 is defined by a radial outer surface 26 and a continuous axial inner retention surface 28.

Figure 2:
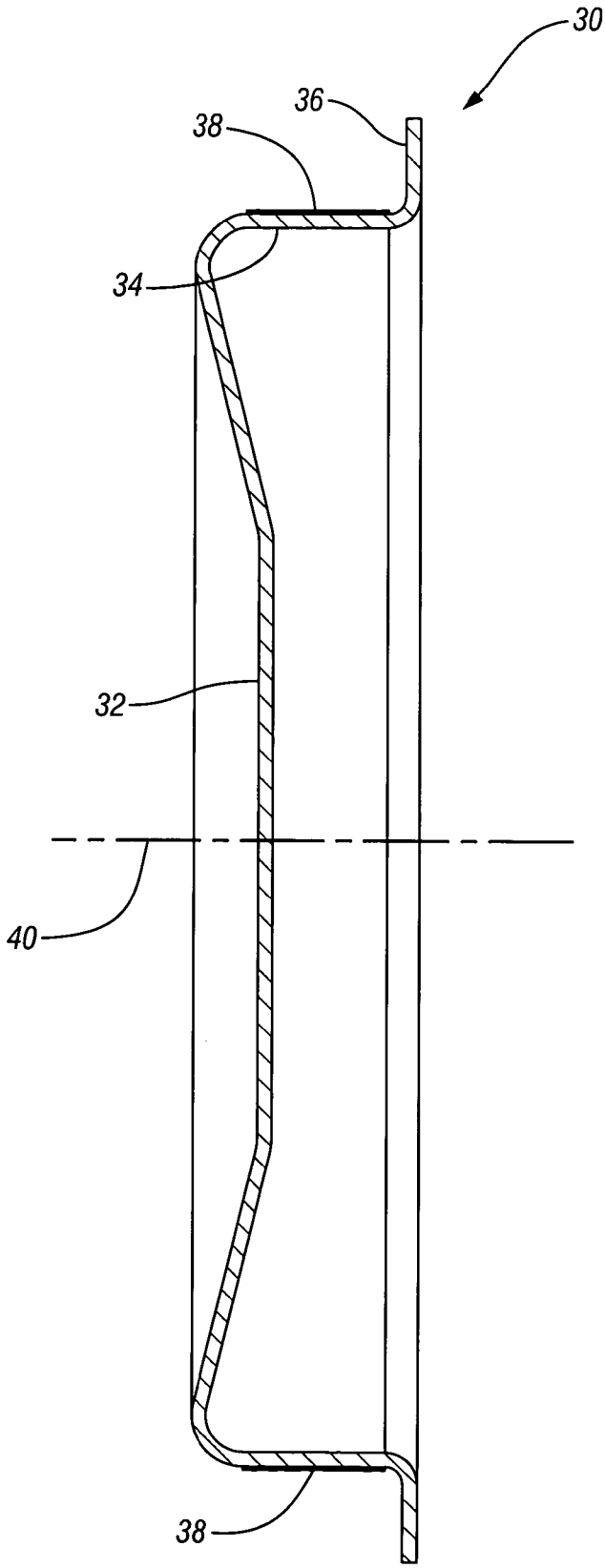
FIG. 2 is a cross-sectional view of a plug forming the closure of the invention.

The opening 24 is closed by a disk shaped plug 30 shown in FIG. 2 and configured to fit in the assembly opening 24 of the housing 12. The plug 30 is formed of sheet metal and includes a radial closure portion 32 surrounded by a continuous axial flange 34 connected outwardly with a radial lip 36. The axial flange 34 is sized to be press fitted into the inner retention surface of the opening 24.

Before assembly a preferably anaerobic adhesive 38 is applied to the adjoining flange and retention surfaces of the plug and the housing to form a hydraulic seal and to increase the retention of the plug within the opening. Preferably, the adhesive 38 is applied to the axial flange 34 of the plug 30. Alternatively, the adhesive 38 may be applied to the inner retention surface 28 of the housing. An anaerobic adhesive which hardens between the surfaces in the absence of air is preferred.

Referring now to FIG. 1, after the impeller assembly is installed within the housing, the plug 30 is pressed into the opening 24 of the housing 12. As the plug 30 is pressed into the opening 24, the axial flange 34 of the plug is pressed inward toward the axis 40 of the plug to create a press fit that retains the plug 30 in the housing 12. When the plug 30 is fully pressed into the housing 12, the radial lip 36 engages the radial outer surface 26 of the housing to provide a stop for the plug to prevent the radial closure portion 36 from contacting the impeller 16. Once the plug 30 and housing 12 are assembled, the adhesive is allowed to set, creating a seal that prevents leakage of the pressurized coolant during engine operation and increases the retaining force of the plug in the opening.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An engine water pump comprising:

a housing having an impeller assembly opening with a continuous axial inner retention surface;

a sheet metal plug having a generally radial closure portion bordered by a continuous axial flange, the flange press fitted into the inner retention surface of the housing; and a sealing adhesive between the axial flange and the inner retention surface.

2. An engine water pump as in claim 1 wherein the housing includes a radial outer surface surrounding the inner retention surface, the plug has a radial lip surrounding the axial flange, and the radial lip of the plug engages the radial outer surface of the housing for positioning the plug in the opening.

3. An engine water pump as in claim 1 wherein the inner retention surface of the opening and the axial flange of the plug are generally cylindrical.

4. An engine water pump as in claim 1 wherein the adhesive is anaerobic.

5. A method of closing an impeller assembly opening in a housing of an engine water pump assembly, the method comprising the steps of:

forming the opening with a continuous axial inner retention surface;

providing a plug having a sheet metal body including a generally radial closure portion surrounded by a continuous axial flange adapted for press fitting into the inner retention surface;

applying a sealing adhesive to one of the axial flange of the plug and the inner retention surface of the opening;

pressing the plug into the opening with the axial flange of the plug press fitted in the inner retention surface of the opening to retain the plug in the opening; and setting the adhesive to seal the assembly opening against fluid leakage and to increase the force of retention of the plug in the opening.

6. A method as in claim 5 wherein the plug includes a radial lip surrounding the axially extending flange, the housing includes a radial outer surface surrounding the inner retention surface, and the pressing step includes forcing the plug flange against the radial outer surface of the housing to position the plug in the opening.

7. A method as in claim 5 wherein the sealing adhesive is anaerobic.

* * * * *